US009575429B2

(12) United States Patent
Iguchi

(10) Patent No.: US 9,575,429 B2
(45) Date of Patent: Feb. 21, 2017

(54) IMAGE FORMING APPARATUS CAPABLE OF PERFORMING COLOR CORRECTION, METHOD FOR CONTROLLING THE APPARATUS, AND STORAGE MEDIUM

(71) Applicant: CANON KABUSHIKI KAISHA, Tokyo (JP)

(72) Inventor: Shunsuke Iguchi, Cupertino, CA (US)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/942,006

(22) Filed: Nov. 16, 2015

(65) Prior Publication Data

US 2016/0139529 A1 May 19, 2016

(30) Foreign Application Priority Data

Nov. 18, 2014 (JP) ..... 2014-233798

(51) Int. Cl.
*G03G 15/01* (2006.01)
*G03G 15/00* (2006.01)

(52) U.S. Cl.
CPC ..... *G03G 15/0178* (2013.01); *G03G 15/5062* (2013.01)

(58) Field of Classification Search
CPC ..... G03G 15/0178; G03G 2215/00063
See application file for complete search history.

(56) References Cited

U.S. PATENT DOCUMENTS

2001/0033387 A1* 10/2001 Nogiwa ..... G06K 15/02 358/1.9
2003/0138261 A1* 7/2003 Tezuka ..... G03G 15/5062 399/49
2008/0273052 A1 11/2008 Imhoff
2011/0058190 A1* 3/2011 Yamada ..... H04N 1/608 358/1.9

* cited by examiner

*Primary Examiner* — Clayton E Laballe
*Assistant Examiner* — Victor Verbitsky
(74) *Attorney, Agent, or Firm* — Canon U.S.A., Inc. IP Division

(57) ABSTRACT

An apparatus forms a patch for gray with toners of CMY for each density region of an image for image formation, acquires a chromaticity value of the patch for gray, determines whether a chroma value obtained from the chromaticity value of the patch for gray for each density region is equal to or greater than a threshold value, generates, for a first density region corresponding to a patch with respect to which a chroma value determined to be neither equal to nor greater than the threshold value is obtained, using the obtained chroma value, a correction value for decreasing the chroma value, and generates, for a second density region corresponding to a patch with respect to which a chroma value determined to be equal to or greater than the threshold value is obtained, a correction value by performing interpolation calculation using the correction value generated for the first density region.

9 Claims, 19 Drawing Sheets

FIG. 13

| PATCH ID | CMYK | DENSITY REGION | C SHIFT | M SHIFT | Y SHIFT |
|---|---|---|---|---|---|
| 1 | 12.5,9.0,9.0,0 | 12.5 | 0 | 0 | 0 |
| 2 | 25.1,18.8,19.8,0 | 25.1 | 0 | −1 | +1 |
| 3 | 37.3,29,28,0 | 37.3 | 0 | +1 | 0 |
| 4 | 49.8,40,40,0 | 49.8 | 0 | 0 | 0 |
| 5 | 62.8,52.9,53.9,0 | 62.8 | 0 | 0 | +1 |
| 6 | 75.3,66.3,66.3,0 | 75.3 | 0 | 0 | 0 |
| 7 | 75.3,66.3,64.3,0 | 75.3 | 0 | 0 | −2 |
| : | : | : | : | : | : |

1301

FIG. 17

| DENSITY REGION | C SHIFT | M SHIFT | Y SHIFT |
|---|---|---|---|
| 12.5 | 0 | −2 | −1 |
| 25.1 | 0 | −3 | −2 |
| 37.3 | 0 | −4 | −3 |
| 49.8 | 0 | −3 | −4 |
| 62.8 | 0 | +5 | −3 |
| 75.3 | 0 | +7 | −2 |

1701

FIG. 18

| GRAY SHIFT DIRECTION | CORRECTION BIASES | COLOR THAT IS TO BE FIXED |
|---|---|---|
| +C | -M, -Y | C |
| +M | -Y, -C | M |
| +Y | -C, -M | Y |
| +R | -M, -Y | C |
| +G | -Y, -C | M |
| +B | -C, -M | Y |

1801

IMAGE FORMING APPARATUS CAPABLE OF PERFORMING COLOR CORRECTION, METHOD FOR CONTROLLING THE APPARATUS, AND STORAGE MEDIUM

BACKGROUND OF THE INVENTION

Field of the Invention

Aspects of the present disclosure generally relate to image forming and, more particularly, to an image forming apparatus capable of performing color correction and a color correction method for the image forming apparatus.

Description of the Related Art

Image forming apparatuses allow calibration for the purpose of preventing or reducing variations occurring due to various factors and of stabilizing the color of an image to be formed by the image forming apparatus. There have been conventionally proposed many techniques about the calibration, which is a color correction method for an image forming apparatus. The proposed techniques include a calibration specialized in gray correction, which is called "G7 calibration", as discussed in U.S. Patent Application Publication No. 2008/0273052 A1.

FIG. 3 illustrates a gray determination patch, which is usable for the G7 calibration.

FIG. 6 illustrates gray correction for each density region in the G7 calibration.

The G7 calibration is a technique to generate a correction curve used to correct the single color of each of cyan, magenta, yellow, and black (CMYK).

The G7 calibration executes the following processes (1) to (3):

(1) After generating correction curves used to correct CMYK single-color gradation characteristics based on the density values, fixing the signal value (the amount of toner to be used) of cyan with respect to a gray formed with CMY toners (hereinafter referred to as a "CMY mixed-color gray");

(2) Then, performing colorimetry on a gray determination patch 301, which is composed of a plurality of segment patches that have consecutive signal values obtained by changing the signal value of magenta and the signal value of yellow toward positive values and negative values; and (3) From among the plurality of segment patches, which constitutes the gray determination patch 301, determining adjustment values, which are a density value of magenta and a density value of yellow, that are set in a patch closest to gray in chromaticity value.

The G7 calibration prints the gray determination patch 301 in a plurality of density regions extending from a low density region to a high density region (the sum of C, M, and Y signal values of which is 300%). Then, the G7 calibration performs colorimetry on the gray determination patch 301 and determines adjustment values for magenta and yellow used for gray correction, thus generating respective correction curves for C, M, Y, and K. The G7 calibration reflects the generated correction curves in the density values of CMYK to be output from the image forming apparatus, thus enabling the color reproduction of a gray that is more visually neutral.

However, the above-mentioned G7 calibration is a technique premised on the assumption that an image forming apparatus used for printing is of the offset printing system. The offset printing apparatus is capable of reproducing the color of a gray that is neutral to some degree even if the sum of CMY signal values is 300%.

On the other hand, with regard to an image forming apparatus of the dry electrophotographic system, although depending on the characteristics of the apparatus, when the sum of CMY signal values becomes more than 200%, toner may become unable to be completely transferred or fixed to an image forming medium.

Therefore, an image forming apparatus of the dry electrophotographic system is generally provided with an application amount limiting device for a color material usable for one fixing operation. If the amount of the color material usable for one fixing operation exceeds an application amount limiting value, the application amount limiting device performs processing for changing the combination of signal values corresponding to the amount of the color material to change the signal values in such a manner as to prevent the amount of the color material from exceeding the application amount limiting value.

Under the influence of the phenomenon of transfer and fixing failure and the change of signal values, the absolute a* and b* values in the L*a*b* color space of the CMY mixed-color gray often deviate from the gray axis in a high density region.

As the absolute a* and b* values become great, in other words, deviate from the gray axis, in the L*a*b* color space, the gray may visually appear as a gray mixed with some color such as green or red.

FIG. 8 is a graph representing the deviation from the gray axis in image forming apparatuses.

A dashed line and a two-dot chain line in the graph of FIG. 8 each indicate the deviation from the gray axis in the GRACoL (General Requirements for Applications in Commercial Offset Lithography) standard based on image forming apparatuses of the offset system in the United States. On the other hand, a solid line indicates the deviation from the gray axis in image forming apparatuses of the dry electrophotographic system.

Furthermore, the abscissa axis of the graph indicates the sum of signal values of the CMY mixed-color gray. The ordinate axis indicates the deviation from the gray axis of the CMY mixed-color gray. The values indicated on the ordinate axis are expressed with C* values (chroma values) in the CIE L*C*h* color space.

Referring to the graph of FIG. 8, it is understood that, with regard to image forming apparatuses of the dry electrophotographic system, the CMY mixed-color gray greatly deviates from the gray axis, in other words, the chroma value becomes great, in high density regions. A double line depicted in parallel with the abscissa axis indicates a predetermined threshold value Th. In the example illustrated in FIG. 8, the threshold value Th is set to "1.5" in delta C*.

FIG. 7 is a graph indicating correction curves for CMY in image forming apparatuses of the offset system.

FIG. 9 is a graph indicating correction curves for CMY in image forming apparatuses of the dry electrophotographic system.

When the gray correction is performed with the deviation from the gray axis set for image forming apparatuses of the offset system illustrated in FIG. 8, the correction curves are smoothly curved as illustrated in FIG. 7. On the other hand, when gray correction is performed with the deviation from the gray axis set for image forming apparatuses of the dry electrophotographic system (the deviation from the gray axis is great in high density regions) illustrated in FIG. 8, the correction curve for magenta is curved in a complicated shape as illustrated in FIG. 9, so that gradation steps occur.

Accordingly, if the gray correction such as the G7 calibration is performed in image forming apparatuses of the dry electrophotographic system, the color reproduction of neutral gray becomes available. However, on the other hand, since gradation steps occur in single colors of CMY, the gradation characteristics of single colors of CMY may be greatly impaired.

SUMMARY OF THE INVENTION

According to an aspect of the present disclosure, an image forming apparatus includes an acquisition unit configured to divide an image, which an image forming unit generates, into density regions, to cause the image forming unit to form a patch for gray to be formed with toners of cyan, magenta, and yellow (CMY) for each of the density regions, and to acquire a chromaticity value with respect to the patch for gray, a determination unit configured to determine whether a chroma value obtained from the chromaticity value of the patch for gray for each density region acquired by the acquisition unit is equal to or greater than a threshold value, and a generation unit configured to generate, for a first density region corresponding to a patch with respect to which a chroma value determined by the determination unit to be neither equal to nor greater than the threshold value is obtained, using the obtained chroma value, a correction value used to decrease the chroma value, and configured to generate, for a second density region corresponding to a patch with respect to which a chroma value determined by the determination unit to be equal to or greater than the threshold value is obtained, without using the obtained chroma value, a correction value by performing interpolation calculation using the correction value generated for the first density region.

According to an exemplary embodiment of the present disclosure, when gray correction is performed based on single-color correction curves, the gradation characteristics of single colors or mixed colors other than gray can be prevented from being degraded.

Further features of the present disclosure will become apparent from the following description of exemplary embodiments with reference to the attached drawings.

BRIEF DESCRIPTION OF THE DRAWINGS

FIG. 13 illustrates a patch management table according to the first exemplary embodiment.

FIG. 17 illustrates a density region shift amount table according to the first exemplary embodiment.

FIG. 18 illustrates the association between the gray shift direction, correction biases, and a color to be fixed according to the second exemplary embodiment.

DESCRIPTION OF THE EMBODIMENTS

Various exemplary embodiments, features, and aspects of the disclosure will be described in detail below with reference to the drawings. It should be noted that the exemplary embodiments described below do not limit the present disclosure defined in the claims, and not all of combinations of features described in the exemplary embodiments are essential for the resolution of issues in the present disclosure.

<Configuration of Apparatus>

Figure 1:
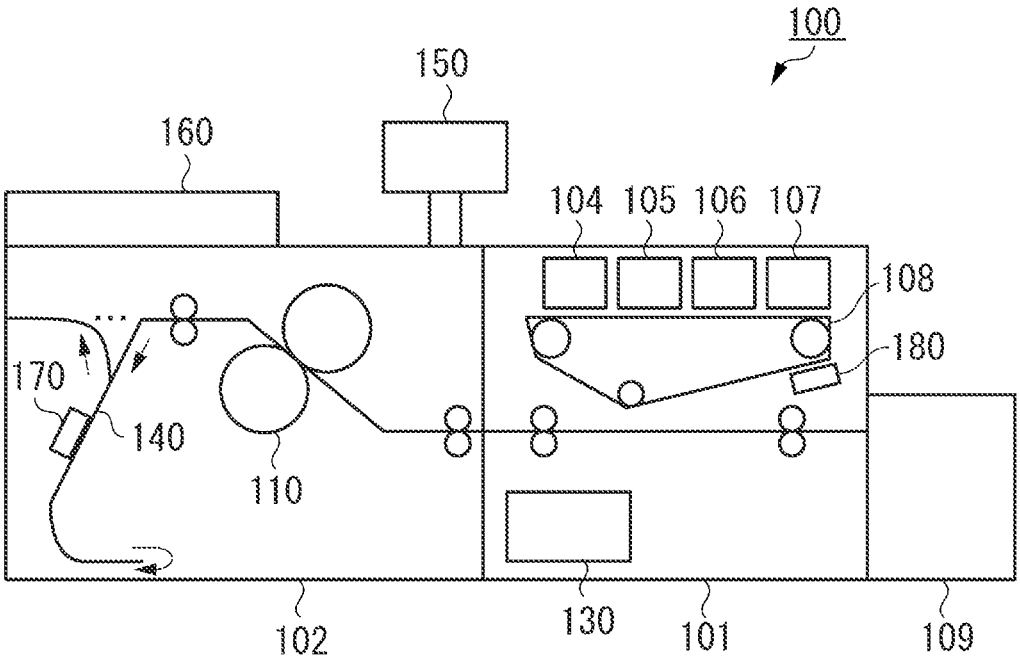
FIG. 1 is a block diagram illustrating an image forming apparatus according to a first exemplary embodiment of the present disclosure.

FIG. 1 is a block diagram illustrating an image forming apparatus according to a first exemplary embodiment of the present disclosure.

Furthermore, an image forming apparatus of the dry electrophotographic system is used as the image forming apparatus according to the present exemplary embodiment. However, the present exemplary embodiment can also be applied to image forming apparatuses of various image forming systems, such as the wet electrophotographic (liquid development) system. In addition, with regard to gray correction, calibration is performed with use of chromaticity values (CIE L*a*b* or CIE L*C*h*). However, the present exemplary embodiment can also be applied to gray correction performed based on other measurement criteria, such as reflection density and spectroscopic spectral distribution.

The image forming apparatus 100 includes a development station 101, a fixing station 102, and a paper feed deck 109. A controller 130 is a control unit that controls each device included in the image forming apparatus 100. An operation unit 150, which includes a liquid crystal device (LCD) and a touch panel, is usable by the operator of the image forming apparatus 100 to check for the printing status or perform various setting operations. A scanner 160 reads a document to generate image information and transfers the image information to the controller 130, thus enabling a copy function. At each of development units 104 to 107 for respective CMYK, an input image from the controller 130 is developed on a photosensitive drum (not illustrated) incorporated in each development device, and toner adheres to a development portion to form a toner image on the photosensitive drum. Then, the toner image developed for each of CMYK is transferred onto an intermediate transfer belt (ITB) 108. As used herein, the term "unit" generally refers to any combination of software, firmware, hardware, or other component, such as circuitry, that is used to effectuate a purpose.

Figure 2:
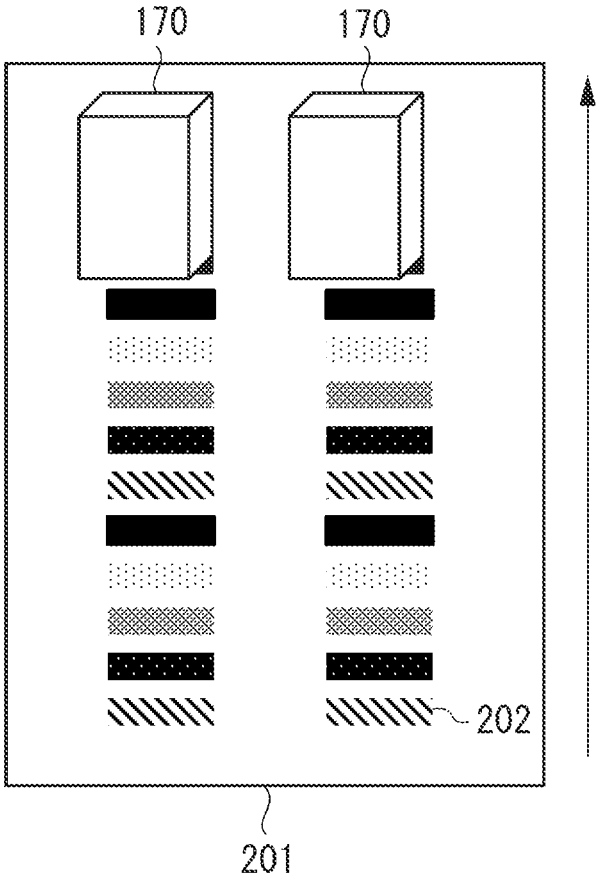
FIG. 2 illustrates how to read measurement charts via spectroscopic sensors according to the first exemplary embodiment.

FIG. 2 illustrates how to read measurement charts via spectroscopic sensors according to the present exemplary embodiment.

A reversal unit 140 is configured to allow a plurality of spectroscopic sensors 170 to be arranged in parallel. In the present exemplary embodiment, two spectroscopic sensors 170 are arranged. A measurement chart 201, which has been conveyed to the reversal unit 140, is reversed at the lower end of the reversal unit 140 and is conveyed upward. The spectroscopic sensors 170 continuously read measurement patches 202 image-formed on the measurement chart 201, which is being conveyed upward.

Furthermore, in a case where a spectral colorimetric device, which is externally connected to the image forming apparatus 100, is used instead of the spectroscopic sensors 170, the user takes out the measurement chart 201 and uses the externally-connected spectral colorimetric device to read measurement patches.

<Configuration of Controller>

Figure 4:
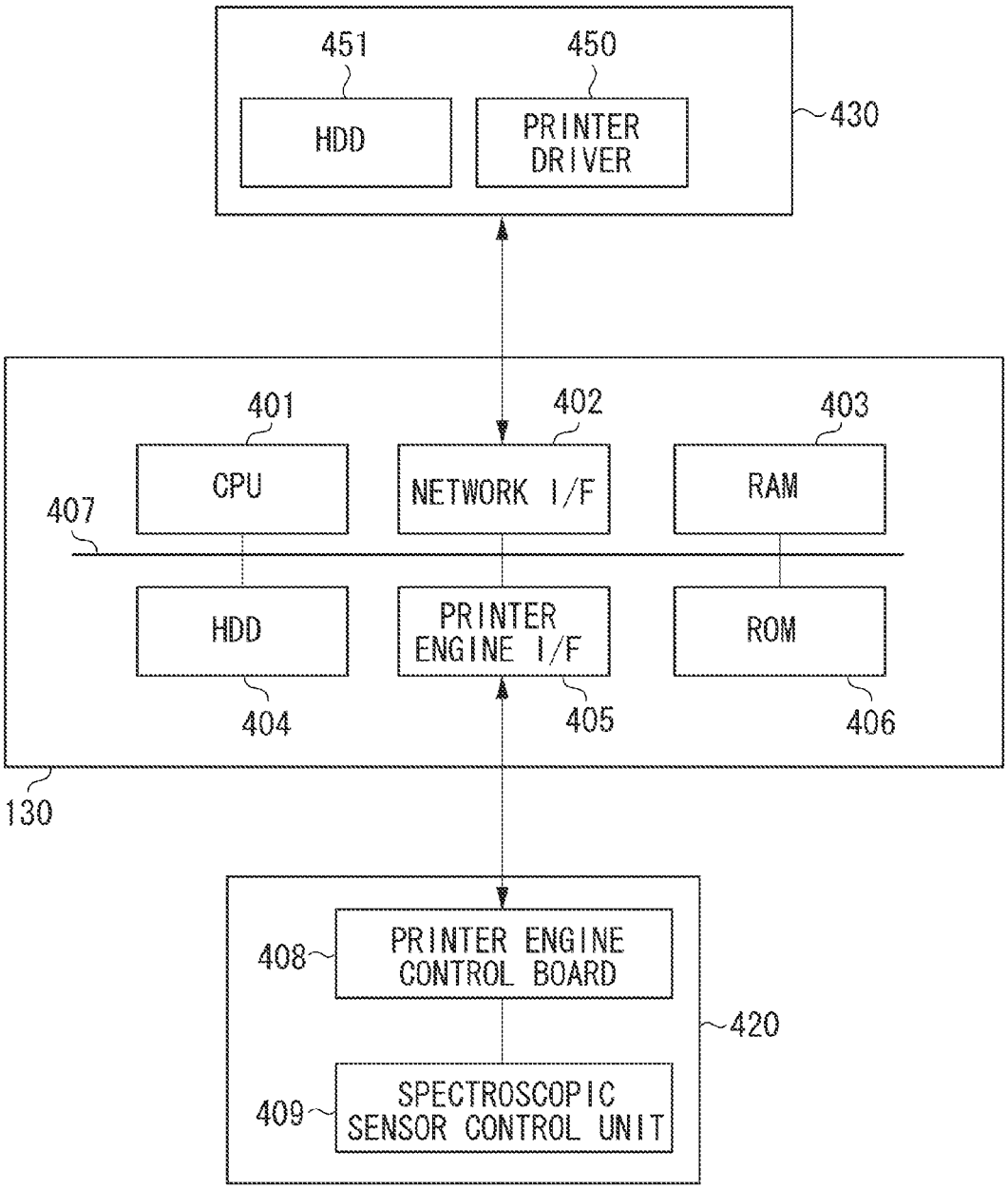
FIG. 4 is a block diagram illustrating a configuration of a controller included in the image forming apparatus according to the first exemplary embodiment.

FIG. 4 is a block diagram illustrating the controller 130 included in the image forming apparatus 100 according to the present exemplary embodiment.

A central processing unit (CPU) 401 executes programs loaded onto a random access memory (RAM) 403 to perform control over each unit of the image forming apparatus 100 and perform calculations. The RAM 403 is used as a storage region for programs, a temporary storage region for various data, and a work memory. A hard disk drive (HDD) 404 is a large-capacity storage device, on which various control programs to be executed by the CPU 401 are installed. Furthermore, the HDD 404 is used as a temporary storage region for various data to be processed. A read-only memory (ROM) 406 is a storage device used to store a starting process program and nonvolatile data for the image forming apparatus 100. When the image forming apparatus 100 is powered on, the starting process program stored in the ROM 406 is activated, so that an operating system (OS) and a control program, which are installed on the HDD 404, are read out and loaded onto the RAM 403. Then, the CPU 401 performs processing according to the program loaded on the RAM 403, thus performing various control processing operations, which are described below. A network interface (I/F) 402 performs communications with other devices, such as a client computer 430, via an external network. A printer engine interface (I/F) 405 performs communications with and control over a printer engine 420. A system bus 407 is a bus connecting the CPU 401 to the above-mentioned various units and is used to transmit control signals, addresses, and data.

In a case where a spectral colorimetric device (not illustrated) externally connected to the image forming apparatus 100 is used, information about measured values is transmitted from the spectral colorimetric device, which is connected to the client computer 430, to the CPU 401 via the network interface (I/F) 402.

The printer engine 420 includes a printer engine control board 408, which performs control over the development station 101 and the fixing station 102 illustrated in FIG. 1, and a spectroscopic sensor control unit 409, which performs control over the spectroscopic sensors 170 and 180.

The client computer 430 is equipped with an HDD 451, on which a printer driver 450 is installed. The printer driver 450 converts a drawing command output from the client computer 430 into page-description language (PDL) data, based on which the image forming apparatus 100 is able to form an image. Furthermore, the printer driver 450 adds various settings of the image forming apparatus 100 to the PDL data and then transmits the PDL added with the various settings to the image forming apparatus 100.

<Configuration of Software Modules>

Figure 5:
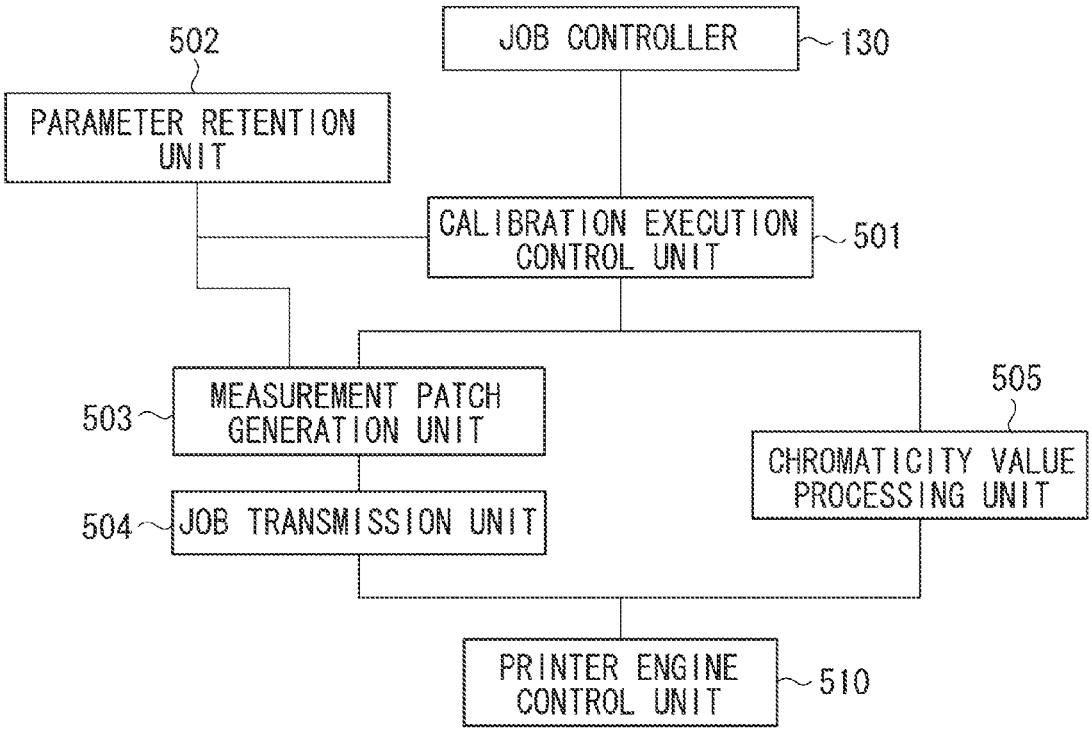
FIG. 5 is a block diagram illustrating software modules according to the first exemplary embodiment.

FIG. 5 is a block diagram illustrating software modules according to the present exemplary embodiment.

Functions of the respective software modules are implemented by the CPU 401 executing the control programs loaded on the RAM 403.

A job controller 130 is a module that performs principal control over the image forming apparatus 100.

A calibration execution control unit 501 is a module that performs principal control over the execution of calibration.

A parameter retention unit 502 reads and stores parameters associated with the execution of calibration, which are stored in the RAM 403, the ROM 406, and the HDD 404.

A measurement patch generation unit 503 generates a measurement chart image, which is used for calibration, based on an instruction from the calibration execution control unit 501.

A job transmission unit 504 transmits the measurement chart image generated by the measurement patch generation unit 503 to a printer engine control unit 510, thus causing the printer engine control unit 510 to perform image formation on a specified sheet.

A chromaticity value processing unit 505 receives, from the printer engine control unit 510, spectroscopic spectral data measured by the spectroscopic sensor control unit 409 and converts the spectroscopic spectral data into a chromaticity value.

<Flow of Printing>

Next, control over the image forming apparatus 100 according to the present exemplary embodiment is described.

Figure 10:
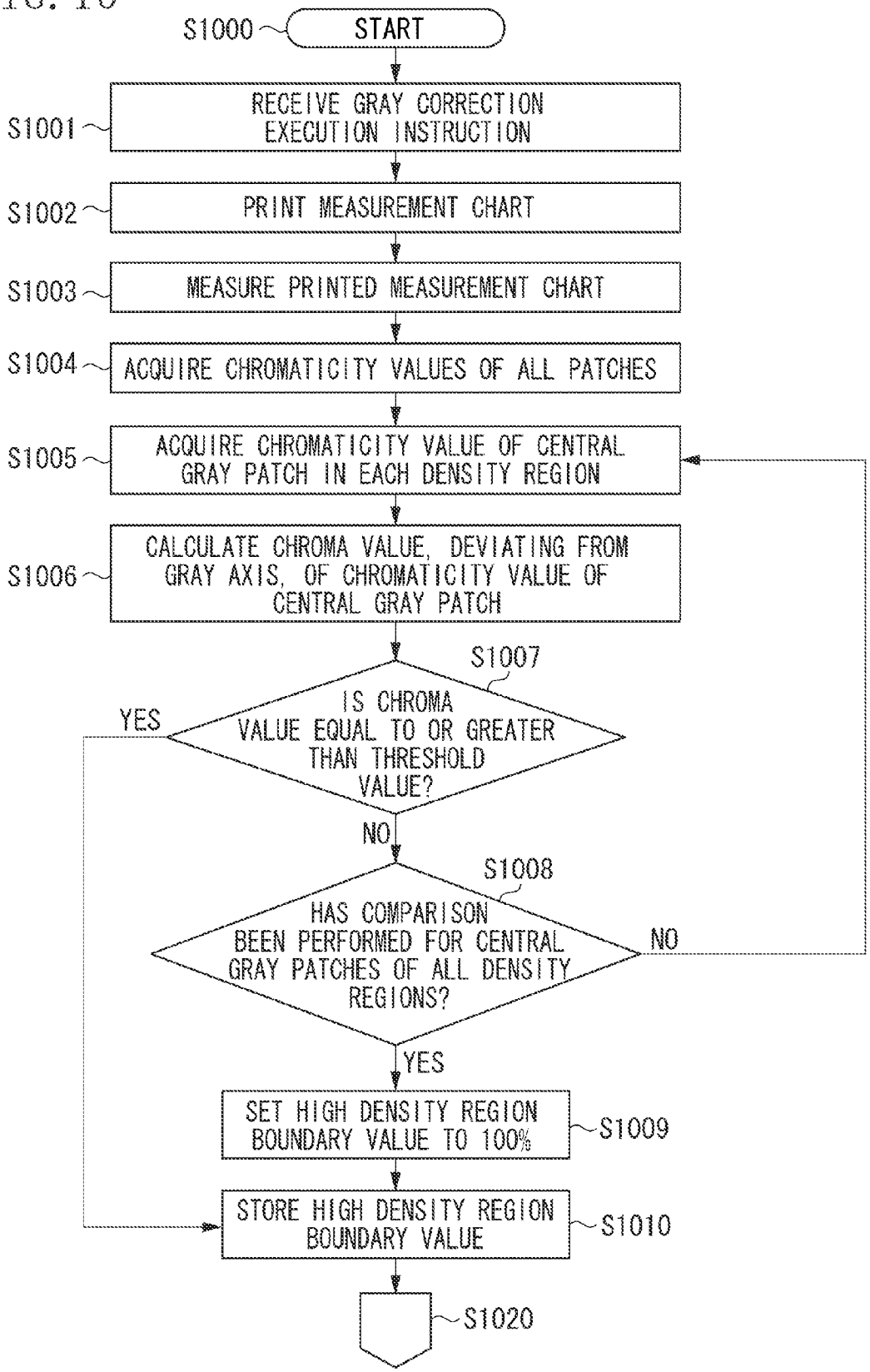
FIG. 10 is a flowchart illustrating control processing performed by the controller of the image forming apparatus according to the first exemplary embodiment.

FIG. 10 is a flowchart illustrating control processing performed by the controller 130 of the image forming apparatus 100 according to the present exemplary embodiment.

Figure 11:
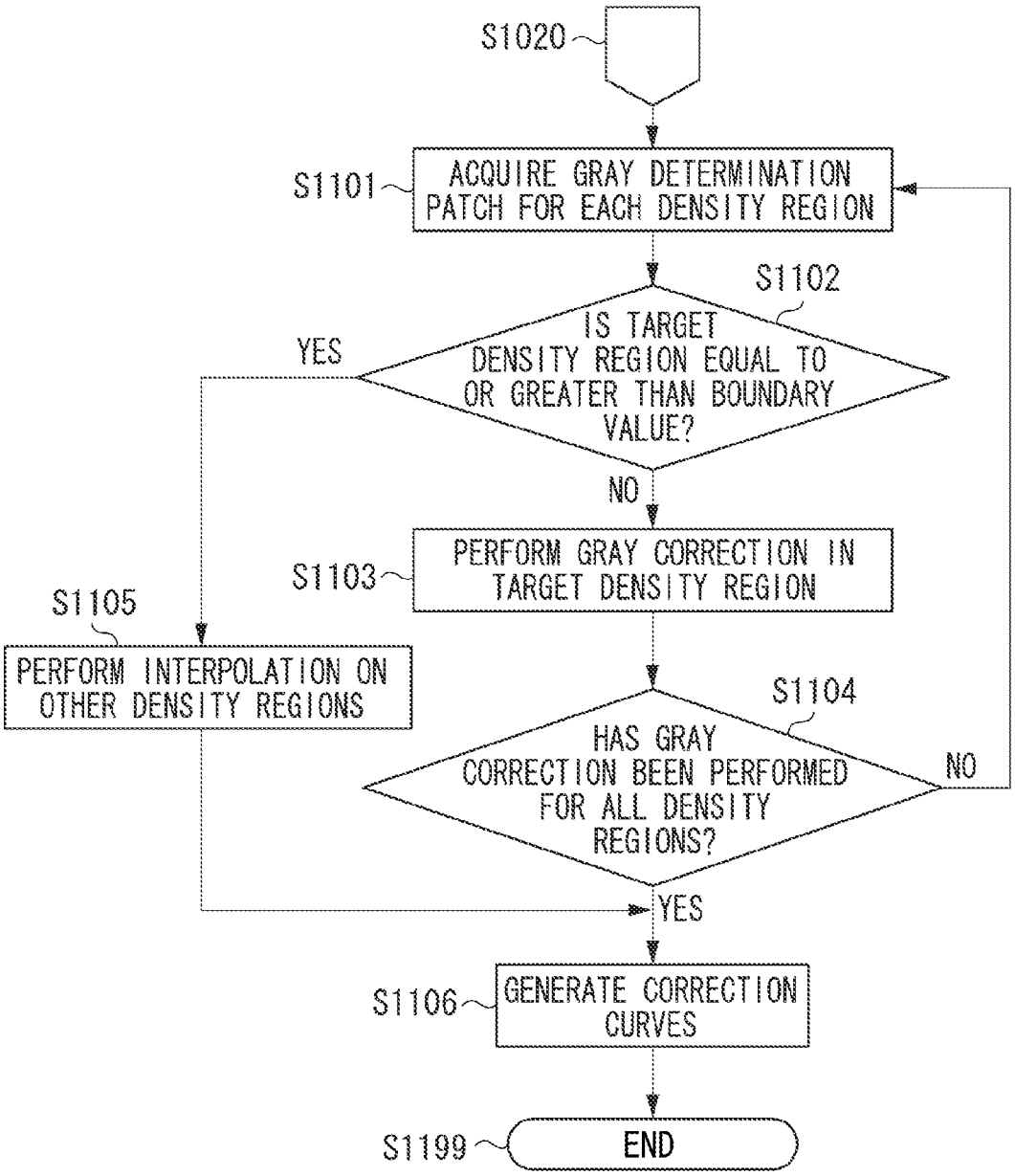
FIG. 11 is a flowchart illustrating control processing performed by the controller of the image forming apparatus according to the first exemplary embodiment.

FIG. 11 is a flowchart illustrating control processing performed by the controller 130 of the image forming apparatus 100 according to the present exemplary embodiment.

Furthermore, a control program for performing the control processing illustrated in FIGS. 10 and 11 is loaded on the RAM 403 as described above, and the control processing illustrated in the flowcharts of FIGS. 10 and 11 is performed by the CPU 401 executing the control programs.

Figure 6:
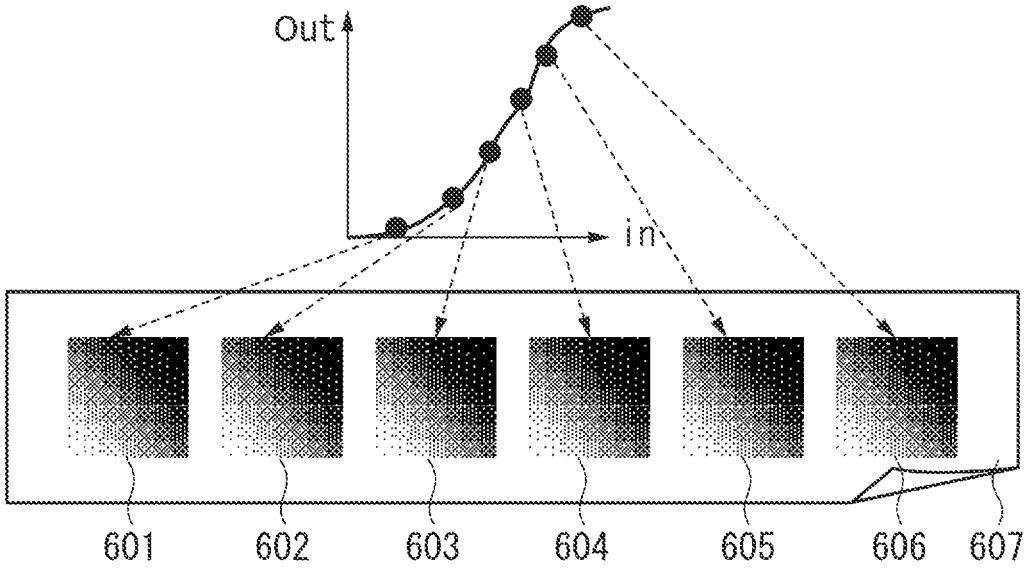
FIG. 6 illustrates gray correction for each density region in the G7 calibration.
Figure 7:
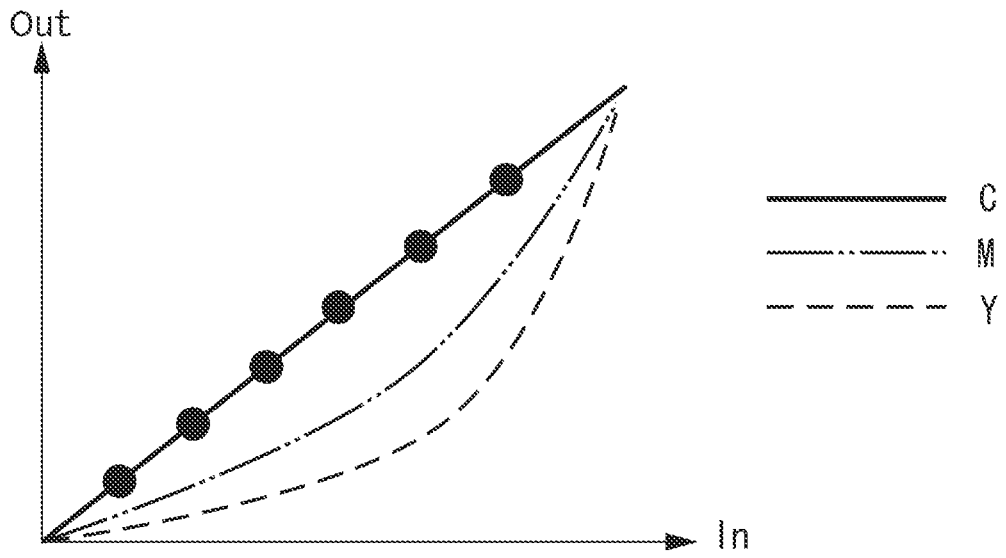
FIG. 7 is a graph illustrating correction curves for CMY in image forming apparatuses of the offset system.
Figure 8:
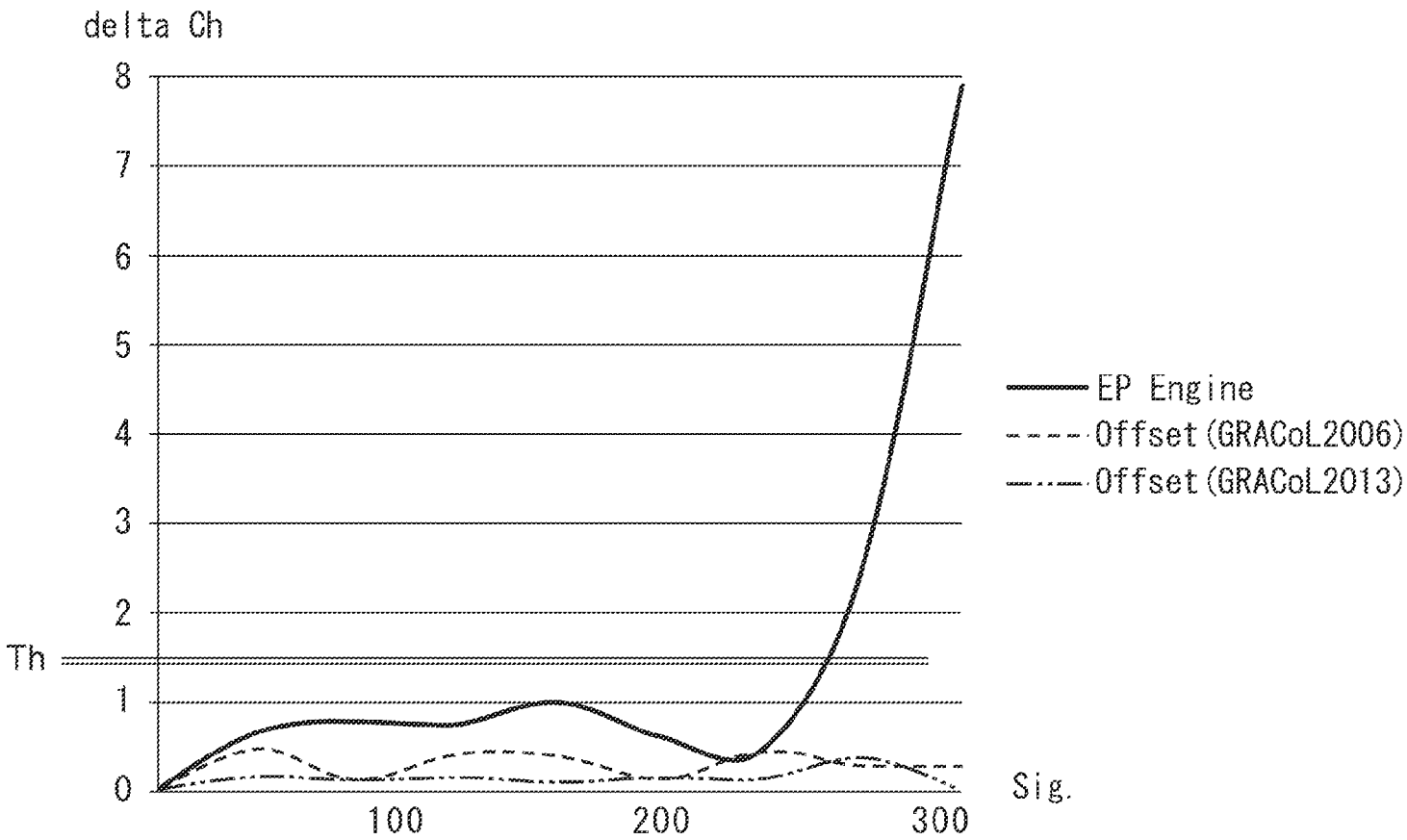
FIG. 8 is a graph illustrating the deviation from the gray axis in image forming apparatuses.
Figure 9:
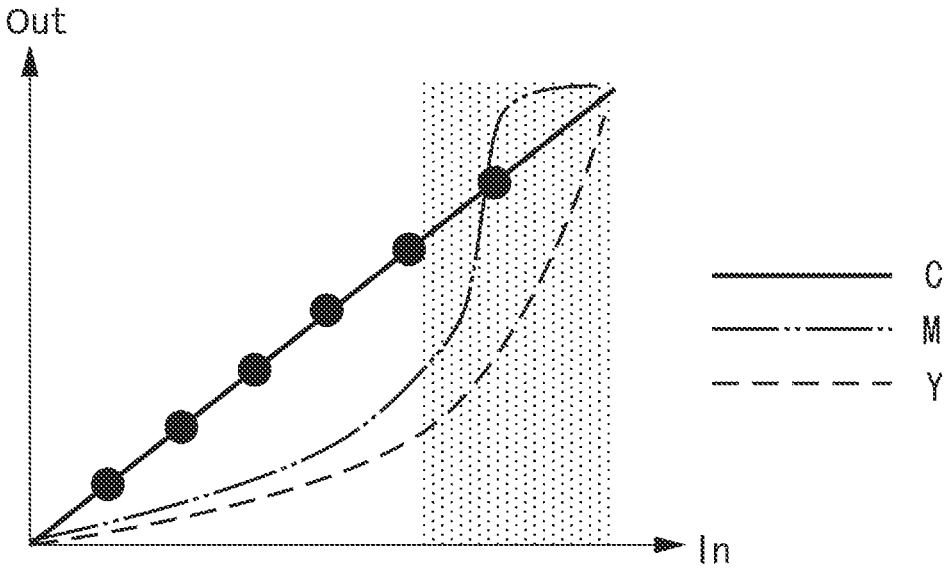
FIG. 9 is a graph illustrating correction curves for CMY in image forming apparatuses of the dry electrophotographic system.

In the present exemplary embodiment, a case where the number of divisional density regions is six as illustrated in FIG. 6 is described as an example.

Figure 3:
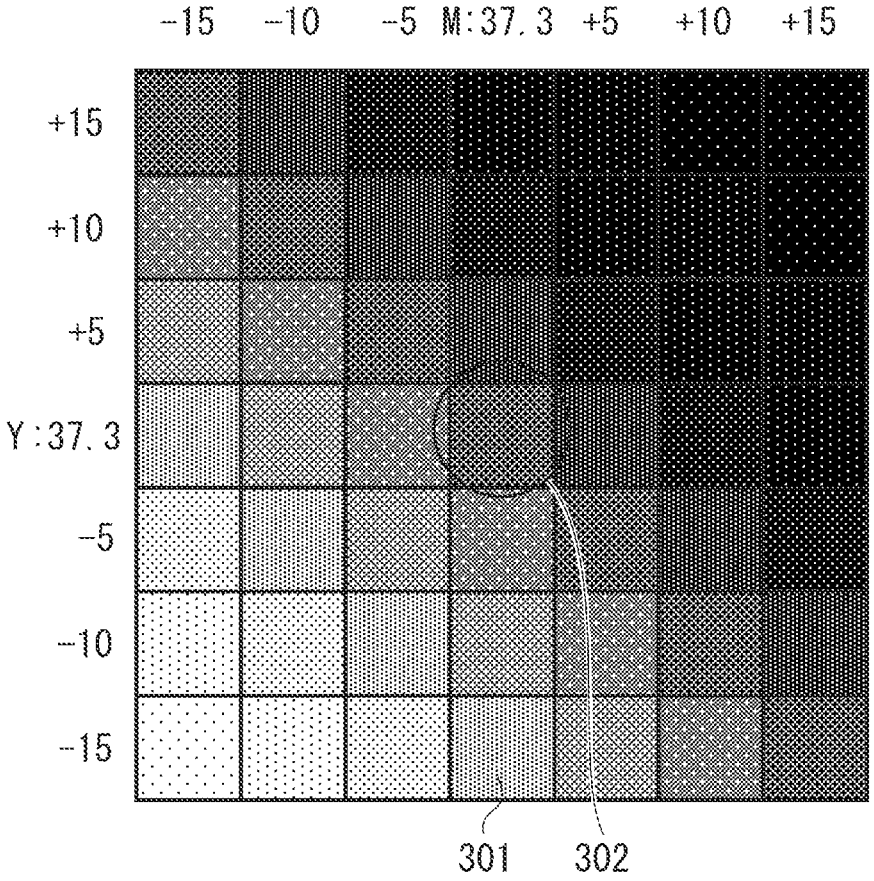
FIG. 3 illustrates a gray determination patch, which is used for the G7 calibration.

For each divisional density region, a gray determination patch as illustrated in FIG. 3 is formed.

Patches 601, 602, 603, 604, 605, and 606 are formed in order from the low density region to the high density region. Each of the patches 601 to 606 is composed of a plurality of segment patches having consecutive signal values. The details of each patch are described below with reference to FIG. 13. Furthermore, a segment patch located at the center of each patch is referred to as a "central gray patch 302".

In step S1000, the job controller 130 starts the processing. In step S1001, the calibration execution control unit 501 receives, from the user via the operation unit 150, a gray correction execution instruction for correcting only gray.

In step S1002, the calibration execution control unit 501 instructs the measurement patch generation unit 503 to generate a measurement chart used for gray correction. The measurement patch generation unit 503 acquires a patch management table 1301 from the parameter retention unit 502 and generates a measurement chart based on the patch management table 1301. Next, the measurement patch generation unit 503 transmits, to the job transmission unit 504, a printing instruction for the generated measurement chart. The job transmission unit 504 instructs the printer engine control unit 510 to print the generated measurement chart. The printer engine control unit 510 performs printing of the generated measurement chart on one of sheets targeted for calibration.

In step S1003, the calibration execution control unit 501 instructs the chromaticity value processing unit 505 to measure the printed measurement chart.

For example, a measurement chart, such as a chart 607 illustrated in FIG. 6, including gray determination patches corresponding to the respective density regions is printed.

The chromaticity value processing unit 505 instructs the printer engine control unit 510 to measure the printed measurement chart. The printer engine control unit 510 instructs the spectroscopic sensor control unit 409 to measure the printed measurement chart via the spectroscopic sensors 170. Furthermore, in a case where a spectral colorimetric device externally connected to the image forming apparatus 100 is used, the user takes out the printed chart and manually performs measurement using the spectral colorimetric device. The chromaticity value is transmitted from the client computer 430 to the job controller 130.

In step S1004, the calibration execution control unit 501 acquires the chromaticity values of all of the patches subjected to colorimetric measurement via the chromaticity value processing unit 505.

FIG. 13 illustrates a patch management table according to the present exemplary embodiment.

The patch management table 1301 is stored in the parameter retention unit 502. The patch management table 1301 includes information about an identifier (ID), CMYK signal values, a density region targeted for a corresponding patch, the amount of C shift, the amount of M shift, and the amount of Y shift with respect to all of the patches used for gray correction included in the measurement chart. The amounts of C shift, M shift, and Y shift are interlocked with the amounts of shifting of cyan, magenta, and yellow in a patch used for gray correction and are amounts by which to increase or decrease the signal values of the correction curve in the plus or minus direction. A patch with all of the amounts of C shift, M shift, and Y shift being zero, in other words, a patch in which C, M, and Y signal values are uniform, is the central gray patch in each density region. Furthermore, a plurality of patches belonging to the same density region aggregates to constitute a single gray determination patch.

As compared with each gray determination patch illustrated in FIG. 6, more specifically, a patch with patch ID "1" is one of patches constituting the gray determination patch 601 illustrated in FIG. 6. Furthermore, the patch with patch ID "1", in which all of the amounts of C shift, M shift, and Y shift are zero, corresponds to the central gray patch of the gray determination patch 601.

Similarly, a patch with patch ID "2" is one of patches constituting the gray determination patch 602 illustrated in FIG. 6. A patch with patch ID "3" is one of patches constituting the gray determination patch 603 illustrated in FIG. 6.

A patch with patch ID "4" is one of patches constituting the gray determination patch 604 illustrated in FIG. 6, and corresponds to the central gray patch of the gray determination patch 604 since all of the amounts of C shift, M shift, and Y shift are zero.

Furthermore, a patch with patch ID "5" is one of patches constituting the gray determination patch 605 illustrated in FIG. 6. Patches with patch ID "6" and patch ID "7" are respective patches of the patches constituting the gray determination patch 606 illustrated in FIG. 6. The patch with patch ID "6" corresponds to the central gray patch of the gray determination patch 606 since all of the amounts of C shift, M shift, and Y shift are zero.

In step S1005, the calibration execution control unit 501 acquires the patch management table 1301 from the parameter retention unit 502. Then, the calibration execution control unit 501 refers to the density regions and acquires the measured chromaticity value corresponding to CMYK values of the central gray patch located at the center of each gray determination patch in order from a gray determination patch with lower signal values.

In step S1006, the calibration execution control unit 501 calculates a deviation value (chroma value: CIE C*), from the gray axis, of the acquired chromaticity value of the central gray patch.

In step S1007, the calibration execution control unit 501 acquires a predetermined threshold value stored in the parameter retention unit 502. Then, the calibration execution control unit 501 compares the chroma value, which indicates the deviation from the gray axis, with the acquired threshold value and determines whether the chroma value is equal to or greater than the threshold value. If the calibration execution control unit 501 determines that the chroma value is neither equal to nor greater than the threshold value (NO in step S1007), the processing proceeds to step S1008.

Figure 19A:
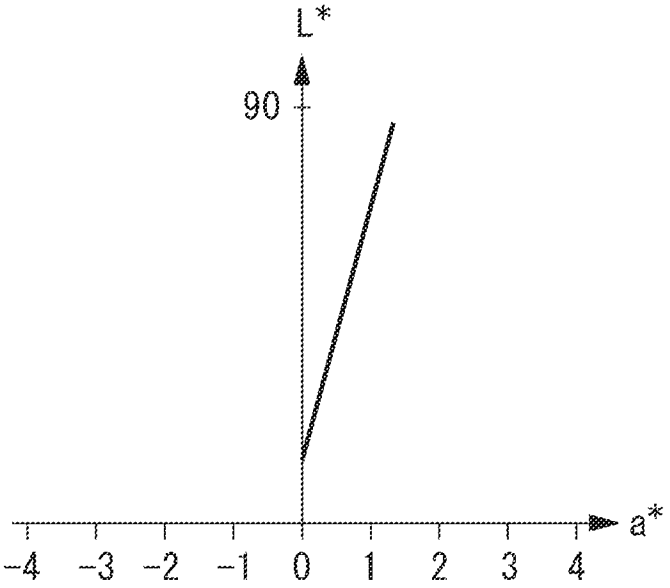
FIGS. 19A and 19B are graphs illustrating the definition of a gray axis according to the first exemplary embodiment.
Figure 19B:
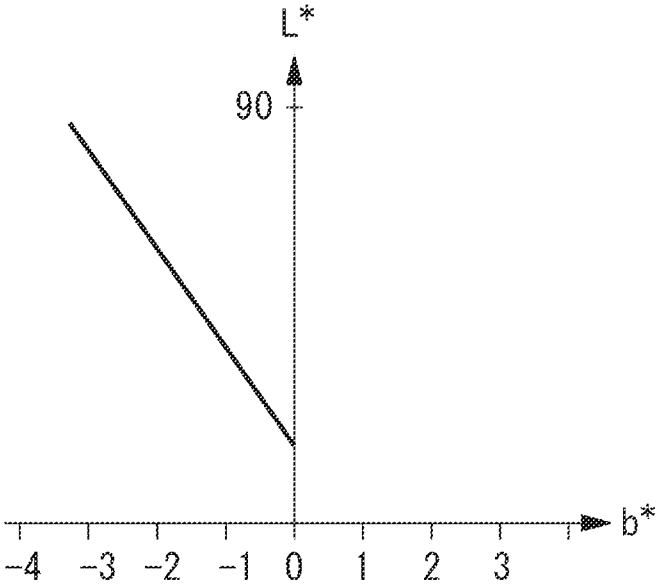

FIGS. 19A and 19B are graphs illustrating the definition of the gray axis according to the present exemplary embodiment.

In the CIE L*a*b* color space, in a case where the basic color of paper is white with a bluish tone, at a position where the lightness value L* is largest (in other words, at the basic color of paper), the a* value resides in the positive direction as illustrated in FIG. 19A, and the b* value resides in the negative direction as illustrated in FIG. 19B. A straight line connecting from the basic color of paper to a point at which the a* value and the b* value are zero in the position of the L* value of the darkest color which the image forming apparatus 100 is able to express on the paper medium is defined as the gray axis. The calibration execution control unit 501 calculates a deviation value from the gray axis with CIE C.

In step S1008, the calibration execution control unit 501 determines whether the comparison between the chroma value acquired based on the patch management table 1301 stored in the parameter retention unit 502 and the threshold value has been performed for the central gray patches of all of the density regions illustrated in FIG. 6. If the calibration execution control unit 501 determines that the comparison between the chroma value acquired from the measurement result of the chromaticity value and the threshold value has already been performed for the central gray patches of all of the density regions (YES in step S1008), the processing proceeds to step S1009. In step S1009, the calibration execution control unit 501 determines that there is no central gray patch having the chroma value equal to or greater than the threshold value in any density value, sets a high density region boundary value to 100%, and stores the high density region boundary value into the parameter retention unit 502.

The high density region boundary value as referred to herein is the sum of signal values of the CMY mixed-color gray obtained when the chroma value has reached the threshold value. Based on the high density region boundary value, processing to be described below is switched.

If, in step S1008, the calibration execution control unit 501 determines that the comparison between the chroma value acquired from the measurement result of the chromaticity value and the threshold value has not yet been performed for the central gray patches of all of the density regions (NO in step S1008), the processing returns to step S1005. Then, the calibration execution control unit 501 performs a comparison between the chroma value acquired from the measurement result of the chromaticity value and the threshold value for a density region that is not yet determined.

If, in step S1007, the calibration execution control unit 501 determines that the chroma value is equal to or greater than the threshold value (YES in step S1007), the processing proceeds to step S1010.

In step S1010, the calibration execution control unit 501 determines that the density region for which the chroma value is equal to or greater than the threshold value has the high density region boundary value, and stores the high density region boundary value into the parameter retention unit 502. In step S1020, the processing proceeds to the flowchart of FIG. 11.

In step S1101 illustrated in FIG. 11, the calibration execution control unit 501 acquires the patch management table 1301 from the parameter retention unit 502. The calibration execution control unit 501 permutes patch IDs in the patch management table 1301 in order of increasing density region. The calibration execution control unit 501 collects all pieces of patch information belonging to the same density region into one group in the patch management table 1301 subjected to permutation. Then, the calibration execution control unit 501 performs colorimetry on patches constituting the gray determination patch of the density region corresponding to the group, thus obtaining chromaticity values.

In step S1102, the calibration execution control unit 501 refers to the parameter retention unit 502 and acquires the high density region boundary value stored in step S1010. Then, the calibration execution control unit 501 determines whether the density region corresponding to the gray determination patch acquired in step S1101 is equal to or greater than the high density region boundary value.

If the calibration execution control unit 501 determines that the density region corresponding to the gray determination patch is less than the high density region boundary value (NO in step S1102), the processing proceeds to step S1103. In step S1103, the calibration execution control unit 501 selects a patch closest to the gray axis (having the least chroma value) from among the chromaticity values obtained by performing colorimetry on a plurality of patches constituting the gray determination patch acquired in step S1101. The calibration execution control unit 501 sets the chroma value of the selected patch as the amount of shift. Then, the calibration execution control unit 501 sets a table listing the amounts of shift for the respective density regions as a density region shift amount table, and stores the density region shift amount table into the parameter retention unit 502.

FIG. 17 illustrates a density region shift amount table 1701 according to the present exemplary embodiment.

The density region shift amount table 1701 is a table used to associate each correction density region with the amount of M shift and the amount of Y shift of the patch closest to the gray axis in each density region.

In each correction density region, the calibration execution control unit 501 performs gray correction using, as correction values, the amounts of shift such as those illustrated in FIG. 17.

More specifically, the calibration execution control unit 501 corrects the CMY signal values, as input signals, using the amounts of shift (correction values) obtained for each density region illustrated in FIG. 17, and outputs the result of correction as output signals.

In step S1104, the calibration execution control unit 501 refers to the patch management table 1301 stored in the parameter retention unit 502, and determines whether the gray correction in step S1103 has been performed for all of the density regions. If the calibration execution control unit 501 determines that the gray correction has not yet been performed for all of the density regions (NO in step S1104), the processing returns to step S1101. Then, the calibration execution control unit 501 performs processing in step S1102 and subsequent steps for the next grouped density region.

If, in step S1102, the calibration execution control unit 501 determines that the density region corresponding to the gray determination patch is equal to or greater than the high density region boundary value (YES in step S1102), the processing proceeds to step S1105.

In step S1105, the calibration execution control unit 501 refers to the parameter retention unit 502, and acquires the amount of M shift and the amount of Y shift in density regions less than the high density region boundary value (low and medium density regions). The calibration execution control unit 501 stores, into the parameter retention unit 502, correction values obtained by performing interpolation calculation on the amount of M shift and the amount of Y shift in the high density region based on the acquired amount of M shift and amount of Y shift in the low and medium density regions.

The interpolation calculation performed in step S1105 is to calculate polynomial approximations using the amounts of shift in the low and medium density regions and to calculate the amount of M shift and the amount of Y shift in the high density region based on the calculated polynomial approximations.

In step S1106, the calibration execution control unit 501 refers to the parameter retention unit 502, and acquires the amount of M shift and the amount of Y shift for each of all the density regions based on the density region shift amount table.

The calibration execution control unit 501 generates respective correction curves for magenta and yellow using interpolation calculation based on the acquired amount of M shift and amount of Y shift. Then, in step S1199, the processing ends.

In this way, with regard to density regions lower than the high density region boundary value (low and medium density regions), the calibration execution control unit 501 performs calibration to acquire the amounts of shift (correction values) for correcting a difference from the gray axis (the chroma value of which is zero), which is a target value. In other words, the calibration execution control unit 501 decreases the chroma value, which is a measured value, using the correction values.

On the other hand, with regard to density regions equal to or greater than the high density region boundary value, the calibration execution control unit 501 performs interpolation calculation without performing calibration to acquire the amounts of shift for correction (correction values). In this way, the calibration execution control unit 501 generates correction values for all of the density regions.

Figure 12:
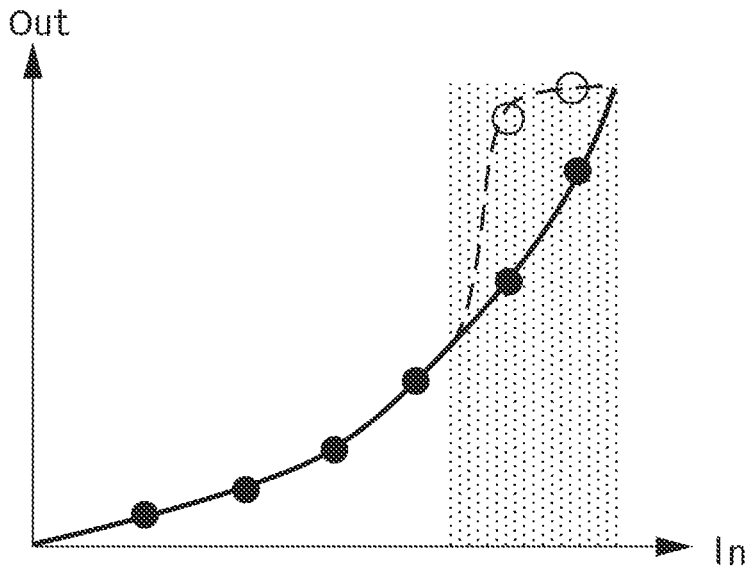
FIG. 12 illustrates a correction curve for magenta according to the first exemplary embodiment.

FIG. 12 illustrates a correction curve for magenta according to the present exemplary embodiment.

A dashed line in FIG. 12 indicates a correction curve that is generated in a case where a conventional technique (G7 calibration) is directly applied to an image forming apparatus of the dry electrophotographic system, and a solid line indicates a correction curve that is generated by the technique described in the present exemplary embodiment. In the graph of FIG. 12, the shaded portion is a region determined as a high density region. For example, suppose a case where the color of gray in a high density region in an image forming apparatus of the dry electrophotographic system is transitioned toward green (greenish gray). In this case, since the correction works in a direction to increase magenta, which is opposite to green in color hue, magenta is emphasized only in a high density region as indicated by the dashed line in FIG. 12, so that gradation characteristics are lost.

On the other hand, according to the present exemplary embodiment, in a case where a deviation from the gray axis is large (the chroma value is equal to or greater than the threshold value) in a high density region, considering that gradation characteristics may be lost, the calibration execution control unit 501 executes an interpolation algorithm without automatically performing gray correction in the high density region, so that smooth gradation characteristics can be maintained.

Furthermore, whether gradation characteristics may be lost is determined within the image forming apparatus, and the color transition of gray varying depending on image forming apparatuses or image forming media (whether another color may be mixed with gray, in other words, whether the chroma value is equal to or greater than the threshold value) can be automatically determined. Therefore, gradation characteristics can be maintained.

In addition, the technique conventionally used in the offset printing system (the processing flow using the same gray determination patch as in gray correction) can also be used for image forming apparatuses of the dry electrophotographic system.

Moreover, in the present exemplary embodiment, since gray in a high density region deviating from the gray axis cannot be corrected, the color of gray may be transitioned (mixed with a specific color) in the high density region. Therefore, the color reproducibility of dark gray may be decreased.

However, since the human vision is insensitive to color in a high density region rather than in low and medium density regions, the color transition is unlikely to be conspicuous in the present exemplary embodiment. Therefore, although the color reproducibility of dark gray may be decreased, the gradation characteristics in low and medium density regions, in which the human vision is sensitive to a difference in color, can be smoothly corrected.

Furthermore, while, in the present exemplary embodiment, gray correction is performed by performing the G7 calibration, corrections to single-color gradation characteristics other than gray correction are performed by a calibration function provided in the image forming apparatus.

Moreover, while, in the present exemplary embodiment, the control operation performed by a controller included in an image forming apparatus has been described, such a control operation can be performed by a client computer.

In the first exemplary embodiment, a method for maintaining gradation characteristics by determining a deviation from the gray axis (chroma value) and executing an interpolation algorithm in a region in which the chroma value is equal to or greater than the threshold value has been described.

In a second exemplary embodiment of the present disclosure, a method for determining in which direction in hue the color transition occurs due to a deviation from the gray axis (chroma value) and smoothly correcting correction curves while returning gray to neutral is described.

In the second exemplary embodiment, the calibration execution control unit 501 performs the determination processing for the high density region boundary value, which has been described in the first exemplary embodiment, with the same processing as in steps S1000 to S1020 illustrated in FIG. 10.

Figure 16:
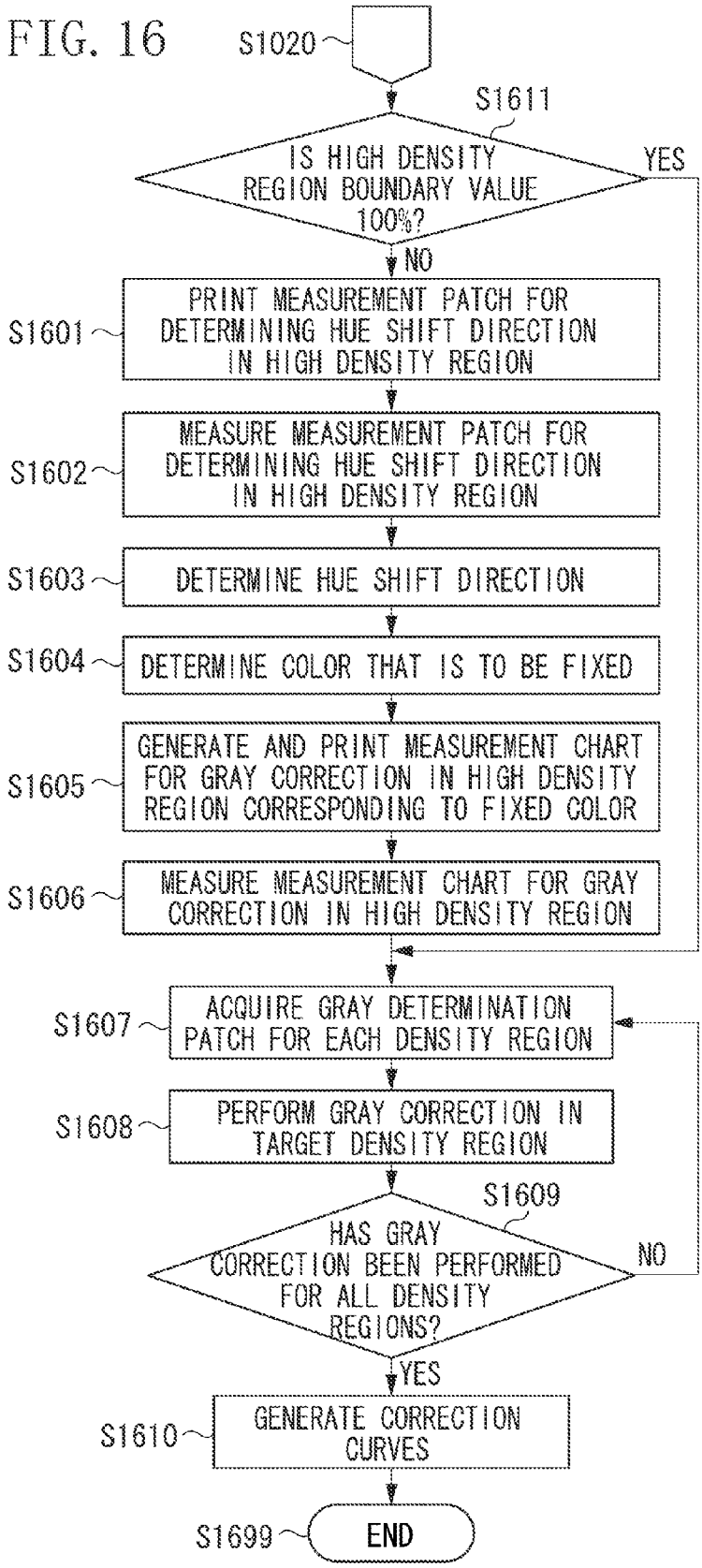
FIG. 16 is a flowchart illustrating control processing performed by the controller of the image forming apparatus according to the second exemplary embodiment.

FIG. 16 is a flowchart illustrating control processing performed by the controller 130 of the image forming apparatus 100 according to the second exemplary embodiment.

In step S1611, the calibration execution control unit 501 refers to the parameter retention unit 502, and determines whether the high density region boundary value stored in step S1010 is 100%, in other words, whether a deviation from the gray axis (chroma value) is less than the threshold value. If the calibration execution control unit 501 determines that the high density region boundary value is 100% (YES in step S1611), the processing proceeds to step S1607. If the calibration execution control unit 501 determines that the high density region boundary value is not 100% (NO in step S1611), the processing proceeds to step S1601.

In step S1601, the calibration execution control unit 501 instructs the measurement patch generation unit 503 to generate a measurement chart used to determine the hue shift direction in a high density region. The measurement patch generation unit 503 generates the measurement chart based on the parameter retention unit 502. Next, the measurement patch generation unit 503 transmits, to the job transmission unit 504, a printing instruction for the generated measurement chart. The job transmission unit 504 instructs the printer engine control unit 510 to print the generated measurement chart. The printer engine control unit 510 performs printing of the generated measurement chart on a sheet targeted for calibration.

In step S1602, the calibration execution control unit 501 instructs the chromaticity value processing unit 505 to measure the printed measurement chart. The chromaticity value processing unit 505 instructs the printer engine control unit 510 to measure the printed measurement chart. The printer engine control unit 510 instructs the spectroscopic sensor control unit 409 to measure the printed measurement chart using the spectroscopic sensors 170. In a case where a spectral colorimetric device externally connected to the image forming apparatus 100 is used, the user takes out the printed chart and manually performs measurement using the spectral colorimetric device. The chromaticity value is transmitted from the client computer 430 to the job controller 130.

In step S1603, the calibration execution control unit 501 determines a hue shift direction based on a result of measurement of a high density region hue shift determination patch.

Figure 14:
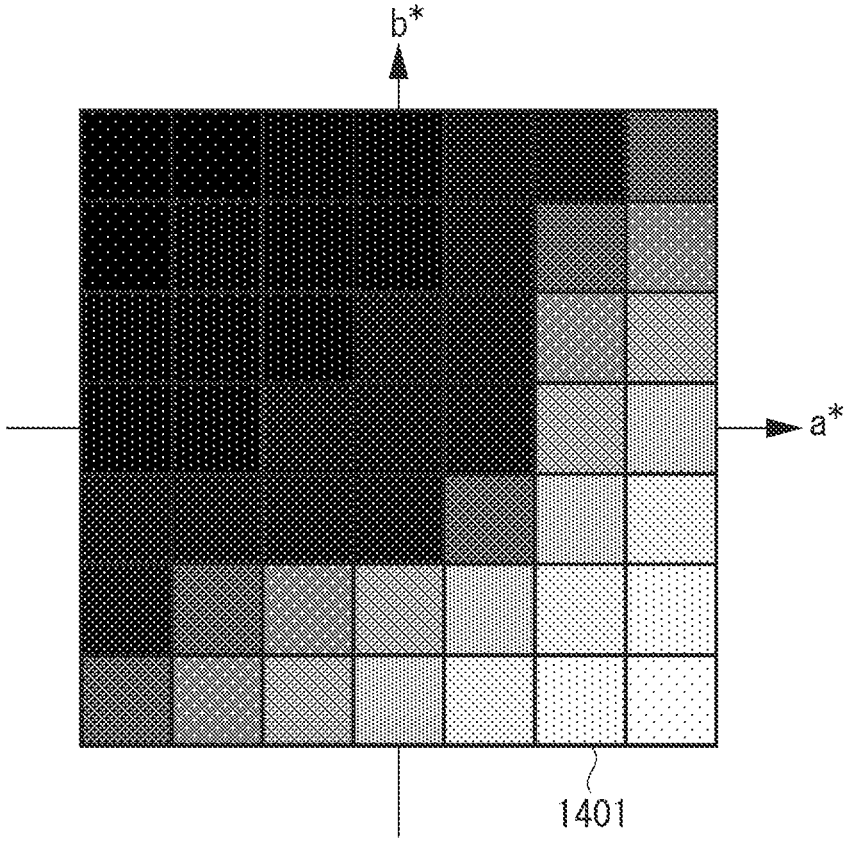
FIG. 14 illustrates a chart for determining the direction of gray hue shift for a high density region according to a second exemplary embodiment of the present disclosure.

FIG. 14 illustrates a chart 1401 for determining a gray hue shift direction in a high density region according to the second exemplary embodiment.

A patch for gray in a high density region is located at the center of the chart 1401 for determining a gray hue shift direction in a high density region. Patches obtained by changing the a* and b* values in the plus and minus directions are arranged around the central patch. After the chart 1401 is printed, a patch closest to the gray axis (a patch for which the chroma value is close to zero) is selected. This enables determining in which direction the gray hue shift occurs in a high density region.

In step S1604, the calibration execution control unit 501 determines a color that is to be fixed in a gray determination patch, based on the determined hue shift direction.

FIG. 18 is a table illustrating the association between the gray shift direction, correction biases, and a color that is to be fixed according to the second exemplary embodiment.

If the gray hue shift direction in the selected patch is determined to be, for example, the direction of green (G), since the G7 calibration, which is premised on offset printing machines, fixes cyan and adjusts magenta and yellow, magenta needs to be greatly corrected. To avoid this issue, fixing magenta and correcting cyan and yellow enables generating correction curves with less amounts of change. Based on such a correspondence table as illustrated in FIG. 18, the calibration execution control unit 501 determines a color that is to be fixed at the time of outputting a chart.

In step S1605, the calibration execution control unit 501 instructs the measurement patch generation unit 503 to generate a measurement chart corresponding to the determined fixed color. The measurement patch generation unit 503 generates the measurement chart based on the parameter retention unit 502. Next, the measurement patch generation unit 503 transmits, to the job transmission unit 504, a printing instruction for the generated measurement chart. The job transmission unit 504 instructs the printer engine control unit 510 to print the generated measurement chart. The printer engine control unit 510 performs printing of the generated measurement chart on a sheet targeted for calibration.

In step S1606, the calibration execution control unit 501 instructs the chromaticity value processing unit 505 to measure the printed measurement chart. The chromaticity value processing unit 505 instructs the printer engine control unit 510 to measure the printed measurement chart. The printer engine control unit 510 instructs the spectroscopic sensor control unit 409 to measure the printed measurement chart using the spectroscopic sensors 170. In a case where a spectral colorimetric device externally connected to the image forming apparatus 100 is used, the user takes out the printed chart and manually performs measurement using the spectral colorimetric device. The chromaticity value is transmitted from the client computer 430 to the job controller 130.

In step S1607, the calibration execution control unit 501 acquires the patch management table 1301 from the parameter retention unit 502. The calibration execution control unit 501 refers to density regions and acquires a chromaticity value of each gray determination patch in order from a gray determination patch having a lower signal value.

In step S1608, the calibration execution control unit 501 determines a patch closest to the gray axis (having the least chroma value) based on the measured chromaticity value corresponding to the gray determination patch acquired in step S1607. Then, the calibration execution control unit 501 sets the chroma value of the determined patch as the amount of shift and stores the density region shift amount table into the parameter retention unit 502.

In step S1609, the calibration execution control unit 501 refers to the patch management table 1301 stored in the parameter retention unit 502, and determines whether the gray correction in step S1608 has been performed for all of the density regions. If the calibration execution control unit 501 determines that the gray correction has not yet been performed for all of the density regions (NO in step S1609), the processing returns to step S1607. Then, the calibration execution control unit 501 performs processing in step S1608 and subsequent steps for the next grouped density region. If the calibration execution control unit 501 determines that the gray correction has been performed for all of the density regions (YES in step S1609), the processing proceeds to step S1610.

In step S1610, the calibration execution control unit 501 refers to the parameter retention unit 502, and acquires the amount of C shift, the amount of M shift, and the amount of Y shift for each of all the density regions based on the density region shift amount table. The calibration execution control unit 501 generates respective correction curves for cyan, magenta, and yellow. Then, in step S1699, the processing ends.

Figure 15:
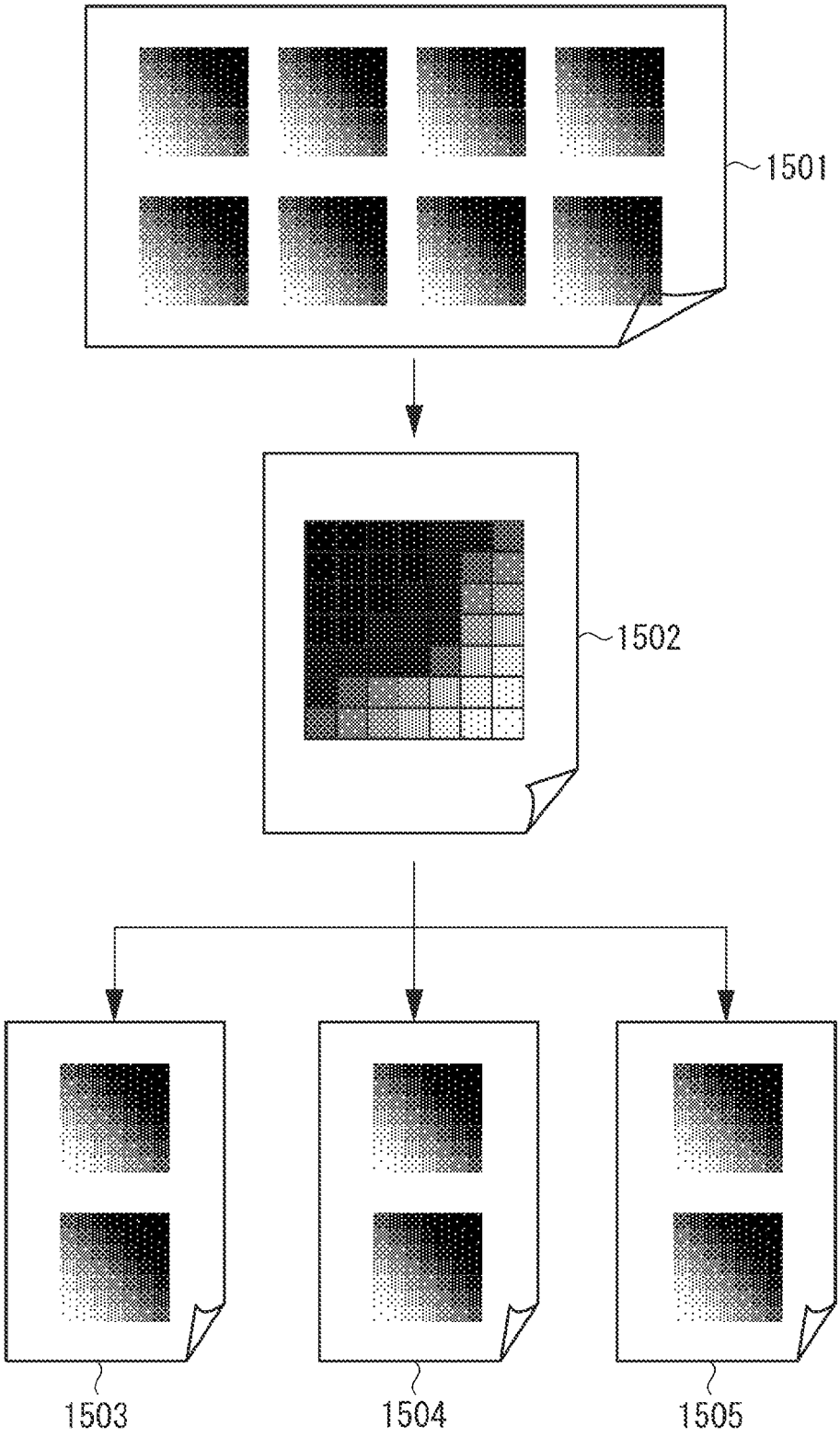
FIG. 15 illustrates the types and flow of measurement charts according to the second exemplary embodiment.

FIG. 15 illustrates the types and flow of measurement charts according to the second exemplary embodiment.

The calibration execution control unit 501 prints and then measures a measurement chart 1501 used for gray correction, and determines the high density region boundary value using the measured values. Next, the calibration execution control unit 501 prints and then measures a chart 1502 for determining a hue shift direction in a high density region, determines the gray shift direction, and determines a color that is to be fixed. Based on the determined color that is to be fixed, the calibration execution control unit 501 prints and then measures one of a gray determination patch 1503 in which C is fixed, a gray determination patch 1504 in which M is fixed, and a gray determination patch 1505 in which Y is fixed, and performs gray correction in a high density region.

With the above-described control operation, gray correction can be performed while preventing the decrease of single-color gradation characteristics in image forming apparatuses of the dry electrophotographic system. Furthermore, gradation characteristics can be maintained even for gray correction in a high density region, which is not into consideration in the case of the first exemplary embodiment.

The present disclosure can also be implemented by performing the following processing operation. Software (program) for realizing the functions of the above-described exemplary embodiments is supplied to a system or apparatus via a network or any type of recording medium, and a computer (or a central processing unit (CPU) or micro processing unit (MPU)) of the system or apparatus reads out and executes the program.

Embodiments of the present disclosure can also be realized by a computer of a system or apparatus that reads out and executes computer executable instructions recorded on a storage medium (e.g., non-transitory computer-readable storage medium) to perform the functions of one or more of the above-described embodiment(s) of the present disclosure, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2014-233798 filed Nov. 18, 2014, which is hereby incorporated by reference herein in its entirety.

What is claimed is:

1. An image forming apparatus comprising:

an acquisition unit configured to divide an image, which an image forming unit generates, into density regions, to cause the image forming unit to form a patch for gray to be formed with toners of cyan, magenta, and yellow (CMY) for each of the density regions, and to acquire a chromaticity value with respect to the patch for gray;

a determination unit configured to determine whether a chroma value obtained from the chromaticity value of the patch for gray for each density region acquired by the acquisition unit is equal to or greater than a threshold value; and a generation unit configured to generate, for a first density region corresponding to a patch with respect to which a chroma value determined by the determination unit to be less than the threshold value is obtained, using the obtained chroma value, a first correction value used to decrease the chroma value, and configured to generate, for a second density region corresponding to a patch with respect to which a chroma value determined by the determination unit to be equal to or greater than the threshold value is obtained, a second correction value by performing interpolation calculation based on the first correction value generated for the first density region and predetermined approximations.

2. The image forming apparatus according to claim 1, further comprising a correction unit configured to correct an image that the image forming unit forms, using the first and second correction values generated by the generation unit.

3. The image forming apparatus according to claim 1, wherein signal values for toners of CMY for forming the patch for gray used to obtain the chroma value used for determination by the determination unit are uniform.

4. The image forming apparatus according to claim 1, wherein the patch formed with toners of CMY is composed of a plurality of patches, and wherein each of the plurality of patches has values obtained by changing signal values corresponding to two types of toners among the toners of CMY.

5. The image forming apparatus according to claim 1, wherein the patch formed with toners of CMY is composed of a plurality of patches, wherein each of the plurality of patches has values obtained by changing signal values corresponding to two types of toners among the toners of CMY, and wherein the generation unit generates the first correction value for the first density region using the least chroma value among chroma values obtained from chromaticity values obtained by measuring the plurality of patches.

6. The image forming apparatus according to claim 1, wherein the chromaticity value acquired by the acquisition unit includes L*a*b* values or L*C*h* values.

7. The image forming apparatus according to claim 1, further comprising a shift direction determination unit configured to determine a shift direction of hue from the chromaticity value of the patch for gray in the second density region, wherein the generation unit generates a third correction value for bringing close to zero a chroma value obtained from a chromaticity value acquired by measuring a patch corresponding to the shift direction determined by the shift direction determination unit.

8. A control method for an image forming apparatus, the control method comprising:

dividing an image, which an image forming unit generates, into density regions, causing the image forming unit to form a patch for gray to be formed with toners of cyan, magenta, and yellow (CMY) for each of the density regions, and acquiring a chromaticity value with respect to the patch for gray;

determining whether a chroma value obtained from the acquired chromaticity value of the patch for gray for each density region is equal to or greater than a threshold value;

generating, for a first density region corresponding to a patch with respect to which a chroma value determined to be less than the threshold value is obtained, using the obtained chroma value, a first correction value used to decrease the chroma value; and generating, for a second density region corresponding to a patch with respect to which a chroma value determined to be equal to or greater than the threshold value is obtained, a second correction value by performing interpolation calculation based on the first correction value generated for the first density region and predetermined approximations.

9. A non-transitory computer-readable storage medium storing computer executable instructions that, when executed by a computer, cause the computer to execute a method comprising:

dividing an image, which an image forming unit generates, into density regions, causing the image forming unit to form a patch for gray to be formed with toners of cyan, magenta, and yellow (CMY) for each of the density regions, and acquiring a chromaticity value with respect to the patch for gray;

determining whether a chroma value obtained from the acquired chromaticity value of the patch for gray for each density region is equal to or greater than a threshold value;

generating, for a first density region corresponding to a patch with respect to which a chroma value determined to be less than the threshold value is obtained, using the obtained chroma value, a first correction value used to decrease the chroma value; and generating, for a second density region corresponding to a patch with respect to which a chroma value determined to be equal to or greater than the threshold value is obtained, a second correction value by performing interpolation calculation based on the first correction value generated for the first density region and predetermined approximations.

* * * * *